US006135368A

United States Patent [19]

Protan

[11] Patent Number: 6,135,368

[45] Date of Patent: Oct. 24, 2000

[54] ROCK DUSTING APPARATUS

[76] Inventor: John M. Protan, P.O. Box 385, Sylvester, W. Va. 25193

[21] Appl. No.: 09/264,382

[22] Filed: Mar. 5, 1999

[51] Int. Cl.[7] ..... A01C 3/06

[52] U.S. Cl. ..... 239/654; 239/143

[58] Field of Search ..... 239/654, 143, 239/325; 222/195, 630; 406/92, 16; 366/107

[56] References Cited

U.S. PATENT DOCUMENTS

| | | | |
|---|---|---|---|
| H1205 | 7/1993 | Pearce et al. | 239/654 |
| 1,998,217 | 4/1935 | Benoit | 239/654 |
| 3,194,443 | 7/1965 | Gurney | 239/654 |
| 5,139,175 | 8/1992 | Krysel et al. | 222/195 |
| 5,269,463 | 12/1993 | Burks | 239/654 |

*Primary Examiner*—Andres Kashnikow
*Assistant Examiner*—Christopher S. Kim
*Attorney, Agent, or Firm*—Hendrickson & Long; Stephen M. Schwartz

[57] ABSTRACT

The present invention is a rock dusting apparatus comprising of a pressure-sealable tank, an air distributor and a means of supplying a source of pressurized air. The air distributor is positioned inside the tank. Rock dust is then placed inside the tank which is then sealed. Air is introduced into the tank through the air distributor which includes a plurality of orifices through which the air passes. The air then mixes with, dries and suspends the rock dust particles. The air stream carrying the entrained rock dust particles exits the tank through an outlet opening thereby distributing the rock dust as required.

2 Claims, 3 Drawing Sheets

ROCK DUSTING APPARATUS

CROSS REFERENCE TO RELATED DOCUMENTS

The present invention relates to Disclosure Document Number 445916 filed with the United States Patent & Trademark Office on Oct. 13, 1998.

STATEMENT REGARDING FEDERALLY SPONSORED RESEARCH OR DEVELOPMENT

Not Applicable

REFERENCE TO A MICROFICHE APPENDIX

Not Applicable

BACKGROUND OF THE INVENTION

The present invention involves a new and improved method of distributing rock dust, particularly for use in underground coal mines.

The risk of explosion associated with the accumulation of coal dust is well-known in the underground coal mining industry. This risk is minimized through the use of rock dust which is distributed near the working face so that a thick layer of rock dust is deposited in the mine entry on the newly exposed mine floor, ribs and roof. In addition, secondary rock dusting operations are required to distribute rock dust in previously excavated mine entries for the purposes of settling out any coal dust which may be entrained in the ventilation air stream of the mine and to maintain the desired layer of rock dust on the mine floor, ribs and roof throughout the mine.

In practice, rock dusting operations are generally accomplished with the use of rock dusting machines. These machines, however, generally require continuous attention by one or more operators, distribute large quantities of rock dust undiscriminatingly and therefore inefficiently, or require the use of other underground mining equipment thereby interfering with production schedules. In addition, these machines generally fall into two categories. First, there are those machines which use complex mechanisms with numerous moving parts to transport the rock dust through the machine and to then distribute the rock dust into the mine entry thereby causing wear on the parts which come in contact with the rock dust. Such machines are described in U.S. Pat. No. 3,871,588 issued Mar. 18, 1975, U.S. Pat. No. 4,510,883 issued Apr. 16, 1985, U.S. Pat. No. 4,673,131 issued Jun. 16, 1987 and U.S. Pat. No. 4,805,702 issued Feb. 21, 1989. Second, there are those machines which rely upon a combination of gravity and pressure differentials, known in the art as venturi effect, to move and distribute the rock dust. The machines which use gravity and pressure differentials generally use small tubes or orifices through which the rock dust must pass and are therefore susceptible to the bridging of the rock dust or otherwise clogging, especially if the rock dust has become wet or otherwise absorbed any moisture, thereby preventing the rock dust from being distributed as required. These types of machines are described in U.S. Pat. No. 3,809,439 issued May 7, 1974, U.S. Pat. No. 4,394,975 issued Jul. 26, 1983 and U.S. Pat. No. 4,538,941 issued Sep. 3, 1985.

Thus, there is a need for a simple rock dusting apparatus which requires little operator attention, which does not interfere with production schedules and which can provide the continuous and controllable distribution of rock dust as needed.

BRIEF SUMMARY OF THE INVENTION

The present invention provides an apparatus for the distribution of rock dust particularly for use in underground coal mines. The apparatus involves a pressure-sealable tank and a blower or some other source of pressurized air. Rock dust is placed inside the pressure-sealable tank and the tank is then sealed. Air is introduced into the bottom of the tank through a plurality of orifices located in an orifice ring. An outlet nozzle is provided in the top of the tank through which air carrying an entrained stream of rock dust exits the tank. The constantly flowing air agitates, dries and suspends the rock dust particles in the air-stream. An impeller may also be mounted inside the tank to facilitate the mixing of the air and the rock dust.

Once the pressure-sealable tank is filled with rock dust, the apparatus can be set to operate unattended for several hours. In addition, the apparatus does not require the use of additional mining equipment and therefore, will not interfere with production schedules. Further, the apparatus is highly portable and may be used anywhere in the mine where rock dusting operations are required and by attaching a flexible hose to the outlet nozzle or adjusting the air flow through the pressure-sealable tank or a combination thereof, the apparatus provides a continuous and highly controllable distribution of rock dust as needed.

DETAILED DESCRIPTION OF THE INVENTION

Figure 1:
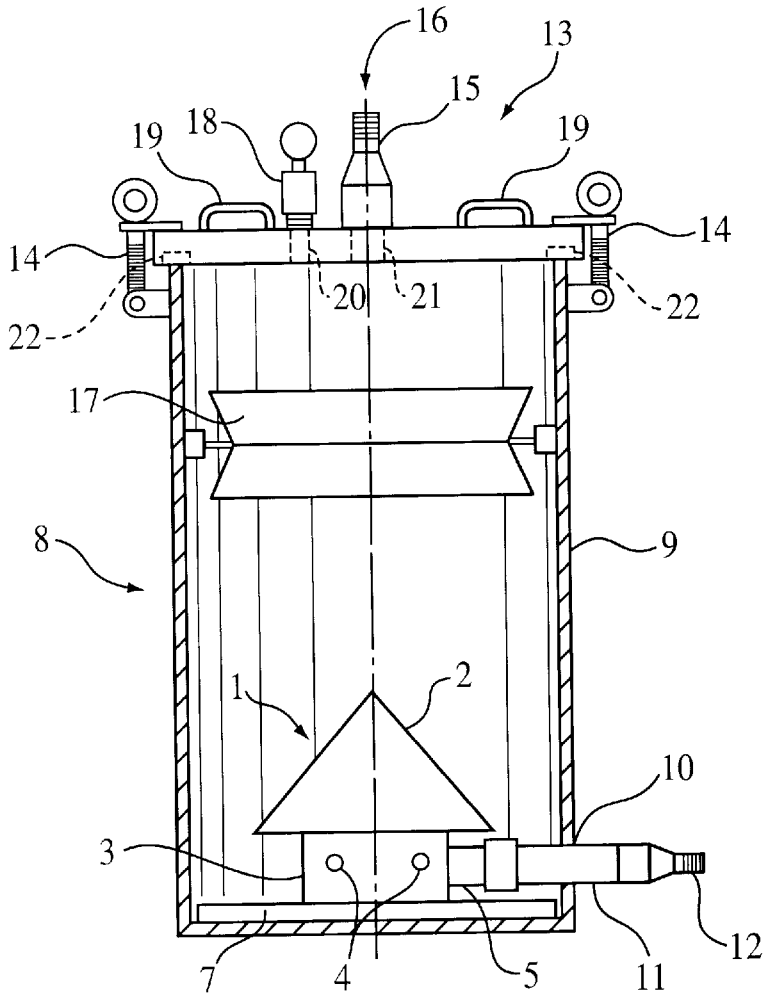
FIG. 1 is a partial sectional side view of the pressure-sealable tank illustrating the air distributor and optional impeller which are positioned inside the tank and the pressure safety device, the outlet nozzle and the air inlet nozzle which is connected to the air distributor which are positioned outside the tank.

Referring to the drawings, FIG. 1 is a partial sectional side view of pressure-sealable tank 8. Tank 8 includes tank body 9, air distributor 1 and tank lid 13. Tank body 9 has a bottom member and sufficient side members to complete the circumference of tank 8. Near the bottom of the side member of tank body 9 is located aperture 10 through which extends tubular member 11. Mounted on one end of tubular member 11 is hollow air intake nozzle 12 which is positioned on the outside of the side member of tank body 9. Aperture 10 is sealed around tubular member 11 such that an air-tight seal is formed between the side member of tank body 9 and tubular member 11.

Near the top of the side members of tank body 9 is mounted a plurality of locking members 14 to engage and lock-down tank lid 13. Also included on tank 8 is optional impeller member 17 rotationally mounted to the side members of tank body 9 on the inside of tank 8.

Figure 2:
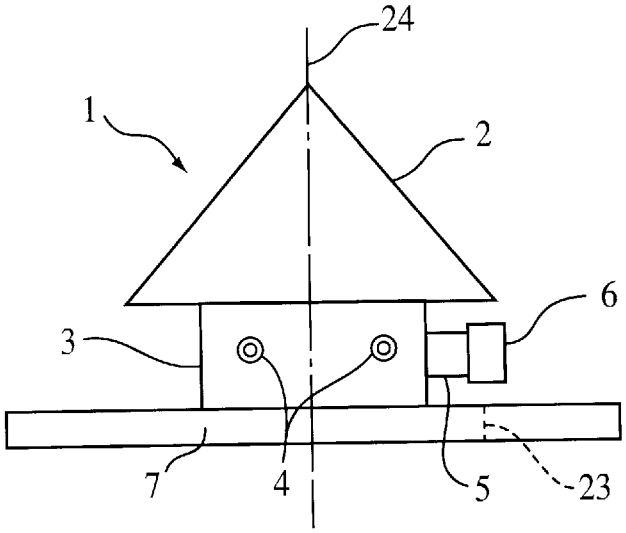
FIG. 2 is an enlarged detail side view of the air distributor shown in FIG. 1.

As illustrated most clearly in FIG. 2, air distributor 1 includes head member 2, orifice ring 3 and base member 7. The extreme top portion of head member 2 is defined substantially as a point from which the side members of head member 2 taper uniformly to the extreme bottom end of head member 2. The extreme bottom end of head member 2 has a circumference equal to or slightly greater than the circumference of orifice ring 3. Orifice ring 3 includes a hollow body member around which are mounted a plurality of orifices 4. On one side of orifice ring 3 is mounted air inlet tubular member 5 having an open end 6. Base member 7 has sufficient dimensions to centrally locate air distributor 1 in the bottom of tank 8 and includes a slot 23 (detail not shown) extending radially from the outer edge of base member 7. Slot 23 has sufficient dimensions to pass over tubular member 11 as air distributor 1 is placed in and removed from tank 8. Head member 2 is sealed on top of orifice ring 3 which is sealed on top of base member 7 such that an air-tight seal is formed between the hollow body member of orifice ring 3 and both head member 2 and base member 7. Head member 2, orifice ring 3 and base member 7 are all centrally positioned along axis 24.

Tank lid 13 includes handles 19, hollow outlet nozzle 15, optional pressure safety device 18 and sealing member 22. Sealing member 22 extends circumferentially around the bottom portion of tank lid 13 substantially in a manner such that when tank lid 13 is placed on the top of the side member of tank body 9, sealing member 22 engages the entire top portion of the side members of tank body 9 thereby creating an air-tight seal between tank lid 13 and tank body 9. Outlet nozzle 15 having open end 16 is mounted on the top of tank lid 13 directly over aperture 21 which extends through tank lid 13. Optional pressure safety device 18 is likewise mounted on the top of tank lid 13 directly over aperture 20.

In operation, tank lid 13 is removed from tank body 9. Air distributor 1 is positioned in the bottom of tank 8 by passing slot 23 over tubular member 11. Tubular member 5 is connected to tubular member 11 at open end 6. Rock dust is placed inside tank 8 and tank lid 13 is locked down on tank body 9 with a plurality of locking members 14. An air stream is introduced into air intake nozzle 12 and is passed through tubular member 11 and tubular member 5 into the hollow body member of orifice ring 3. The air stream exits the hollow body member of orifice ring 3 through a plurality of orifices 4 where the air encounters, dries, mixes with and suspends the rock dust particles. Optional impeller 17, rotationally mounted to the side members of tank body 9 on the inside of tank 8 is turned by the action of the air stream and rock dust as it passes through tank 8 thereby facilitating the mixing of the air and rock dust. The air carrying an entrained stream of rock dust exits tank 8 through outlet nozzle 15 and open end 16.

Figure 3:
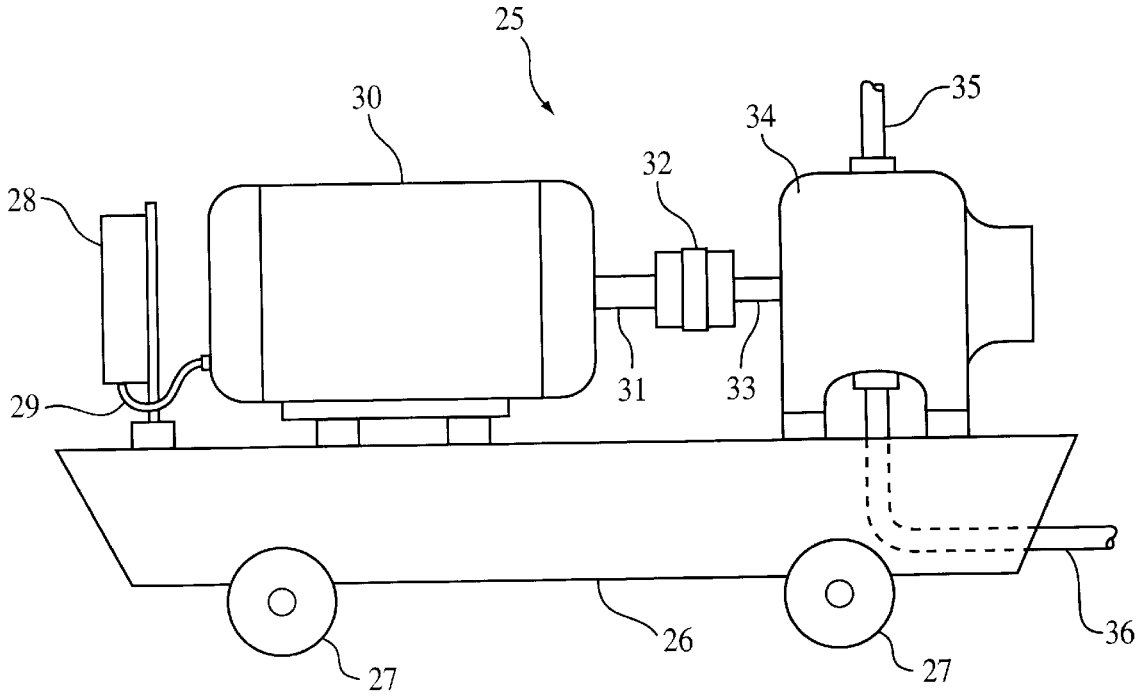
FIG. 3 is a side view of the blower assembly used to supply air to the pressure-sealable tank shown in FIG. 1.

FIG. 3 illustrates the blower assembly 25. The blower assembly 25 includes base member 26 upon which is mounted electric motor control panel 28, electric motor 30 and blower 34. Conductor 29 carries electric current from electric motor control panel 28 to electric motor 30 in a standard manner known to those skilled in the art. Electric motor 30 rotates electric motor shaft 31 which is connected by coupling 32 to blower shaft 33. Blower shaft 33 rotates blower 34 which draws air through air intake 35, pressurizes the air and exhausts a pressurized air stream through air outlet 36. Also shown in FIG. 3 only, optional wheel members 27 are mounted to base 26 in a standard manner known to those skilled in the art.

Figure 4:
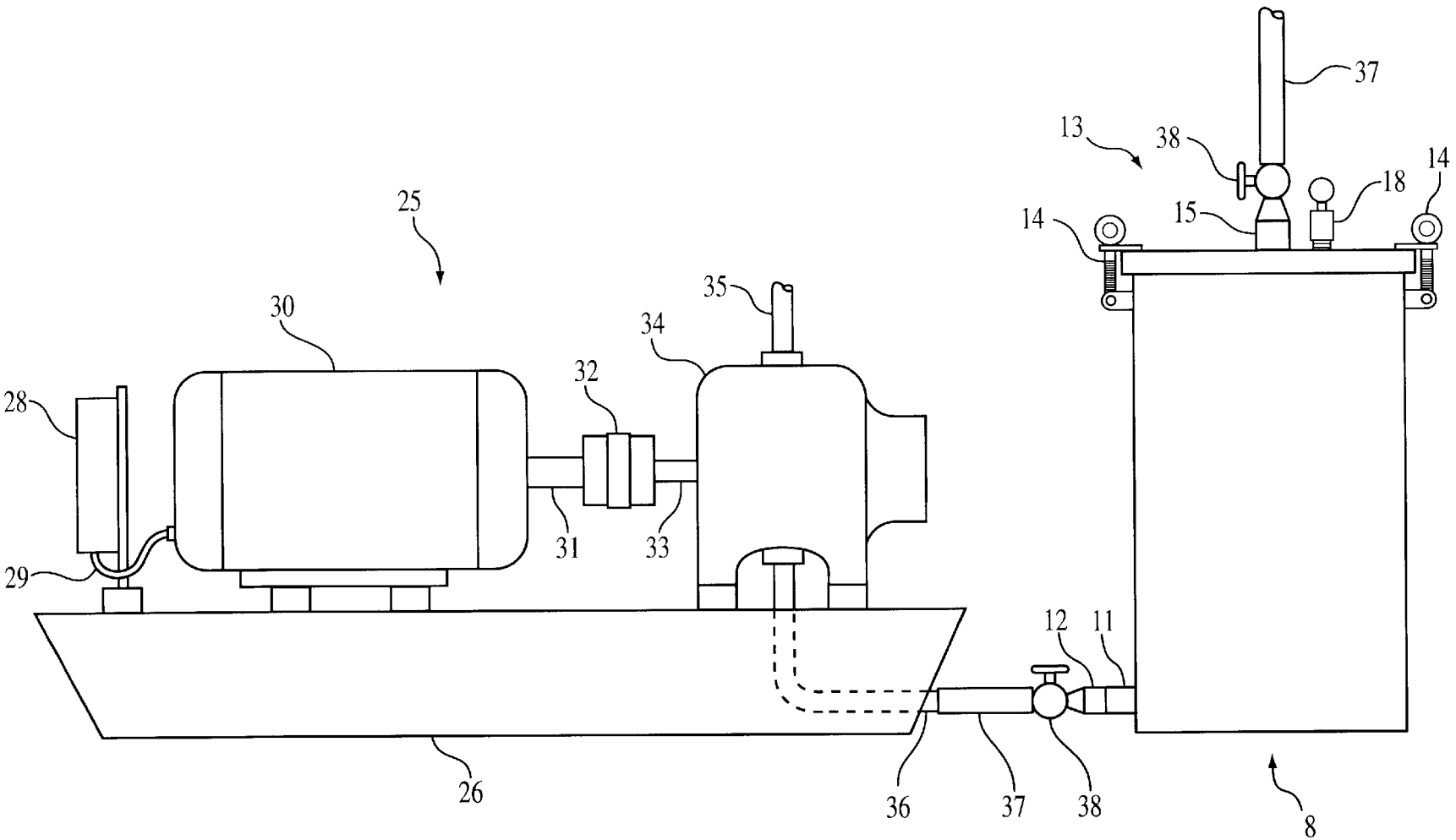
FIG. 4 illustrates the connection between the blower assembly shown in FIG. 3 and the pressure-sealable tank shown in FIG. 1.

FIG. 4 illustrates the rock dusting apparatus including blower assembly 25 and tank 8. As previously described and illustrated in FIG. 3, blower assembly 25 provides a pressurized air stream through air outlet 36. Air outlet 36 is connected by tubular member 37 to air intake nozzle 12 mounted on tank 8 as previously described and illustrated in FIGS. 1 and 2. The pressurized air stream then passes through tubular member 11 into tank 8 by way of air distributor 1 (not shown in FIG. 4). The air carrying an entrained stream of rock dust then exits tank 8 through outlet nozzle 15.

Also shown in FIG. 4 are optional valve members 38 which may be positioned in the pressurized air stream either upstream of air intake nozzle 12 or downstream of outlet nozzle 15 to provide control of the air stream and thereby control the rate at which rock dust is exited from tank 8. In addition, a second tubular member 37 may be mounted on outlet nozzle 15 or optional valve 38 to provide directional control of the air carrying the entrained stream of rock dust after it leaves tank 8.

I claim:

1. A rock dusting apparatus comprising:

(a) a tank for containing a quantity of rock dust, said tank having an inlet opening and an outlet opening, said inlet opening having an outside portion and an opposite inside portion;

(b) an air distributor located inside the tank, said air distributor having an orifice ring with a circumference, a head member, an inlet opening and a plurality of orifices positioned around said orifice ring, said head member having a bottom portion positioned on the orifice ring and having an extreme top portion defined substantially as a point and side members which taper uniformly between the extreme top portion and the bottom portion to a circumference substantially equal to the circumference of said orifice ring;

(c) tubular means extending from the inside portion of the tank inlet opening to the air distributor inlet opening; and (d) means for supplying a stream of pressurized air to the outside portion of the tank inlet opening, said stream of pressurized air passing through the tank inlet opening, through the tubular means, through the air distributor inlet opening, through the air distributor and through the plurality of orifices into the tank whereupon the rock dust will be agitated and suspended into the stream of pressurized air and blown outwardly through the tank outlet opening.

2. A rock dusting apparatus as defined in claim 1, wherein said tank includes an axis; and said air distributor includes a base member positioned under the orifice ring, said base member having sufficient dimensions to substantially center said air distributor along the axis of said tank.

* * * * *